US005243682A

United States Patent [19]

Eberts

[11] Patent Number: 5,243,682

[45] Date of Patent: Sep. 7, 1993

[54] HAIR DRYER WITH AN ISOLATED HEATER ELEMENT

[75] Inventor: Allen F. Eberts, Batavia, Ill.

[73] Assignee: The Tonjon Company, Aurora, Ill.

[21] Appl. No.: 255,844

[22] Filed: Oct. 11, 1988

[51] Int. Cl.[5] ..... H05B 1/00

[52] U.S. Cl. ..... 392/370; 392/374

[58] Field of Search ..... 219/366-370, 219/371, 373-374; 34/99, 96, 98; 392/366-374, 360, 363, 364, 379-381, 384, 385

[56] References Cited

U.S. PATENT DOCUMENTS

| | | | |
|---|---|---|---|
| 2,514,528 | 7/1950 | Wahl | 219/39 |
| 3,418,452 | 12/1968 | Grabner | 219/370 |
| 3,612,824 | 10/1971 | Berryman | 219/370 |
| 3,668,370 | 6/1972 | Pattison | 219/370 X |
| 3,857,016 | 12/1974 | Meyer et al. | 219/368 |
| 3,955,065 | 5/1976 | Chambon | 219/371 |
| 4,198,558 | 4/1980 | Benty | 219/370 |
| 4,309,595 | 1/1982 | Long et al. | 219/370 |
| 4,523,080 | 6/1985 | Bolton | 219/362 |
| 4,629,864 | 12/1986 | Wilson | 219/371 X |
| 4,683,370 | 7/1987 | Petersen et al. | 219/370 |
| 4,738,196 | 4/1988 | Boissevain | 219/370 X |

*Primary Examiner*—Jonathan Wysocki
*Attorney, Agent, or Firm*—Willian Brinks Olds Hofer Gilson & Lione

[57] ABSTRACT

A wall mounted hair dryer, having a stationary heated air supply, a portable dryer head and a flexible hose connecting the two, is provided with an isolated heater element which controls the temperature gradient profile of the discharge conduit of the air supply unit, thereby maintaining a hot central core surrounded by a relatively cool blanket of air. Consequently, the components of the air supply unit, the coupling hose and the dryer head may all be constructed of economical plastics without component failure due to heat degradation.

2 Claims, 3 Drawing Sheets

HAIR DRYER WITH AN ISOLATED HEATER ELEMENT

FIELD OF THE INVENTION

The present invention relates to heater elements for hair dryers and, more particularly, to an isolated heater element for a wall mounted hair dryer which allows passage of air both through and around the heater element.

BACKGROUND OF THE INVENTION

A variety of electric hot air blower devices are known for the drying of hands and for the drying, shaping and styling of hair. Such devices, whether portable or not, commonly contain fans, heater elements and conduit means which permit the direction of air flow through the fans, over the heater elements and through an outlet in a selected direction. In the specific application to which the present invention primarily pertains, a wall mounted hair dryer base unit is connected at its outlet to a handle by a flexible plastic hose which serves as a transmission member for heated air exiting the base unit outlet downstream of the heater element. The operator of this device grasps and aims the handle to focus the heated air exiting therefrom as desired for hair drying or styling purposes.

Typically, in such wall mounted hair dryer units, the inlet air is forced through a heater element which is of the electrically resistive type. The heater element is comprised of a number of resistance elements extending across the inner circumference of the outlet air flow conduit. The heating of the air is accomplished by convection as the air passes across the resistance elements.

The air emerges from the conduit, downstream of the heater element, at temperatures reaching into the vicinity of 140° Centigrade. This high temperature air must then travel through the transmission member, such as the flexible plastic hose, to the handle. Use of a hose with a handle at the end allows the user better control of the direction of the outlet air to particular areas of wet hair and assists the drying and/or styling process.

Heretofore, the temperature of the air exiting the dryer's heater element has caused damage to certain dryer parts or has required special high temperature materials at the interface of the heated air supplying conduit and the transmission hose. Such high temperature materials usually cost more than the materials typically utilized in the conduit and hose elements.

As a result of the high temperature of the air exiting the outlet conduit, and because of the fire safety and cost considerations relating thereto, there has existed a need for an improved apparatus for safely and reliably attaching a transmission hose to a base heater unit.

The hair dryer of the present invention avoids the foregoing shortcomings and fulfills the desired objectives by isolating the heater element within the heated air supplying conduit and allowing cooler air to pass along the outside of the heater element, thereby creating an inner circumference of heated and separated from the conduit by an outer circumference of cooler air.

SUMMARY OF THE INVENTION

It is an object of the present invention to provide an improved wall mounted hair dryer which is safe, reliable and can be manufactured at a lower cost.

It is another object of the present invention to provide a wall mounted hair dryer having an improved air flow circuit such that no damaging and potentially hazardous hot spots occur at the junction of the hot air transmission hose and the base unit's outlet conduit.

It is still a further object of the present invention to adapt the heater element of a wall mounted hair dryer to allow the passage of air along the outside thereof simultaneously as air passes through the inside of the heater element, such that an exiting hot central core of air is surrounded by a cooler blanket of air.

The above described objects, as well as other advantages described herein, are inventively achieved with a specially configured baffling, insulating and mounting arrangement for directing high pressure air through a conduit mounted heater element and discharging it. Typically, the heater element is centrally disposed within a discharge conduit for the air flow circuit of a hair dryer base unit. The heater element is surrounded by an insulating baffle which is configured and aligned to establish a laminar stream of air both within itself and between the outside surface of the baffle and the peripheral wall of the discharge conduit. Thus, the outlet of the discharge conduit includes a substantially laminar air flow with a hot central core surrounded by a relatively cool blanket of air. The relatively cool outer blanket of air keeps the components connecting to the transmission hose of the hair dryer, into which the air flow discharges, free from exposure to the hot central core region, so that less expensive plastic materials may be used in the fabrication of connecting components.

BRIEF DESCRIPTION OF THE DRAWINGS

FIG. 2 is an exploded view of the air supply unit for the hair dryer assembly shown in FIG. 1.

DESCRIPTION OF THE PREFERRED EMBODIMENT

The present invention incorporates the concept of baffling a high pressure laminar stream of air in a conduit to divide the air stream into a central core laminar air stream and an annular peripheral laminar air stream isolated from, but enveloping, the central core air stream, heating the central core air stream, and insulating the heated central core air stream to prevent the heated central core air stream from substantially heating the annular peripheral air stream. Because a relatively high pressure source of air is used in combination with a baffling and heating arrangement which allows substantially laminar flow for the central core and annular peripheral air streams, the discharge of air from the air baffling and heating system maintains a relatively cool blanket of air which surrounds a hot central core.

Figure 1:
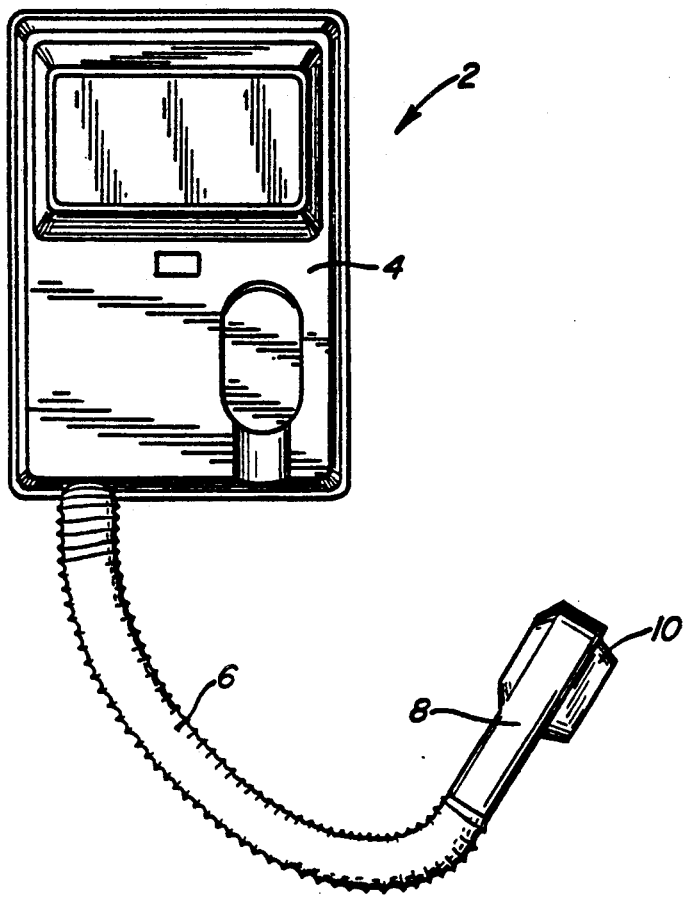

This concept is readily achieved with the preferred embodiment of the invention, which is illustrated and described as installed in a conventional wall mounted hair dryer. Referring to the drawings, wherein like characters designate like or corresponding parts throughout the views, FIG. 1 shows a typical hair dryer assembly 2 in which the present invention may be included. The dryer assembly 2 has a stationary heated air supply unit 4 for discharge of high temperature forced air into a coupling hose 6. The coupling hose 6 feeds the high temperature forced air from the air supply unit 4 through a portable dryer head 8. The portable dryer head 8 discharges the high temperature forced air through a dryer head discharge nozzle section 10.

Figure 2:
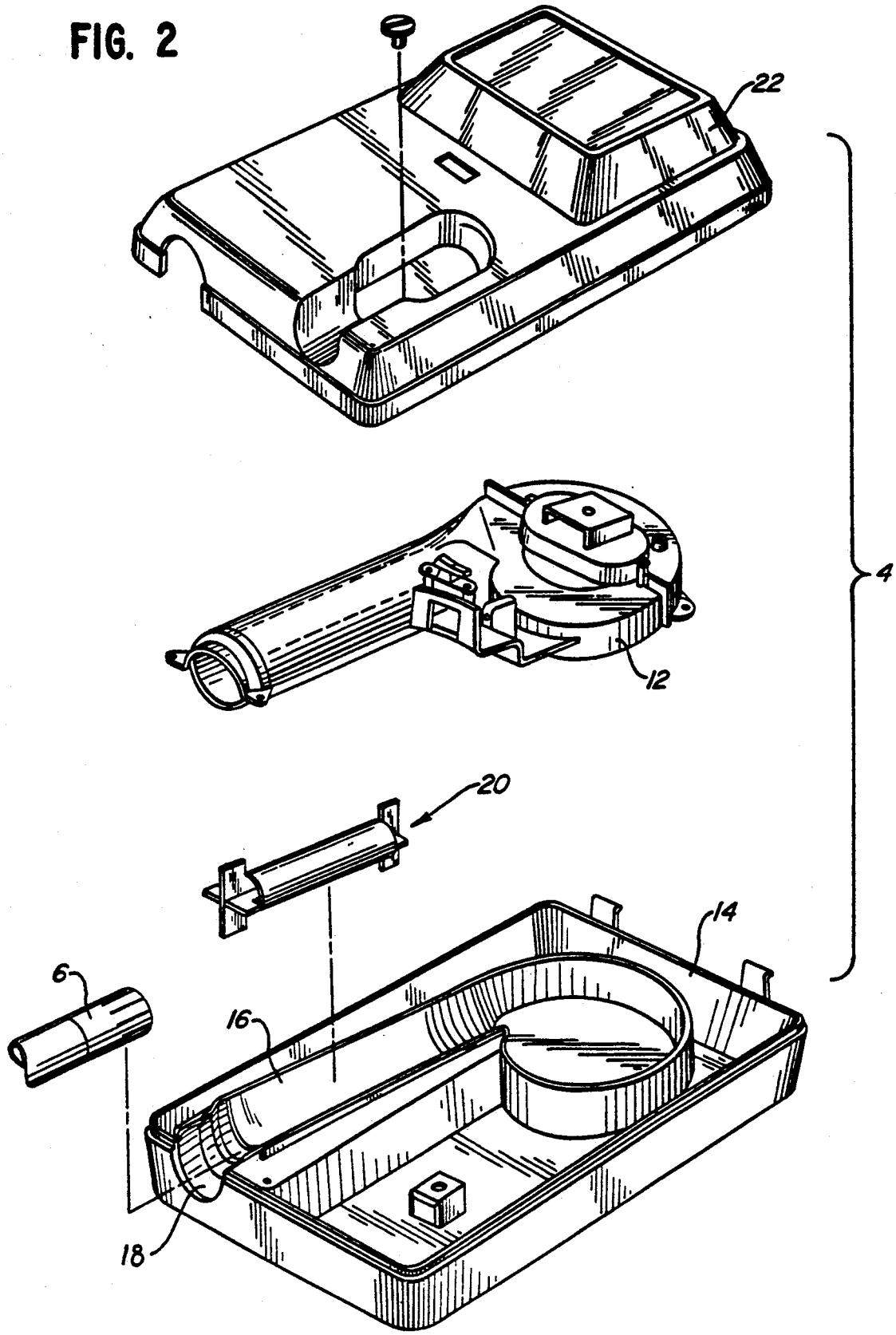
FIG. 2 is a typical wall mounted hair dryer assembly incorporating the present invention.

The portion of the dryer assembly 2 which is generally subject to very high temperatures is the discharge interface between the supply unit 4 and the coupling hose 6. This is because heated air is usually generated within the supply unit and proximate its discharge into the coupling hose 6 for maximum efficiency and minimum temperature rise within the air supply unit 4. An exploded view of the air supply unit 4 is shown in FIG. 2. The air supply unit includes an air blower and baffle assembly 12 which engages with a mounting base and baffle assembly 14 to establish a high pressure air cavity with a discharge conduit 16 and a discharge outlet 18. A heater element assembly 20 is interposed between the air blower and baffle assembly 12 and the mounting base and baffle assembly 14 to mount inside the discharge conduit 16. The heater element assembly 20 is axially aligned to permit the high pressure air flow in the discharge conduit 16 to remain substantially laminar. A top cover 22 fastens onto the mounting base and baffle assembly 14 to protect the air supply unit components and wiring. The coupling hose 6 attaches to the discharge outlet 18.

Figure 3:
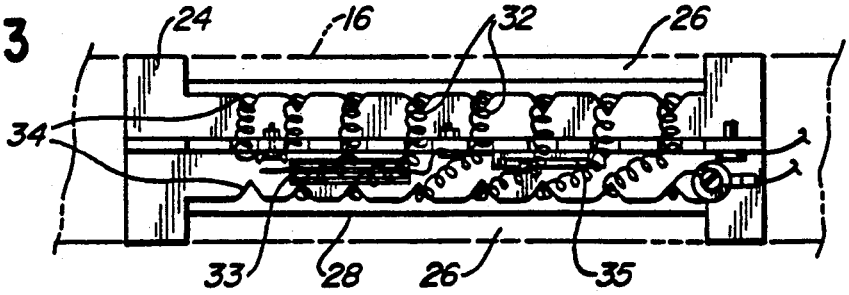
FIG. 3 is a side view of the heater element assembly for the air supply unit shown in FIG. 2.
Figure 4:
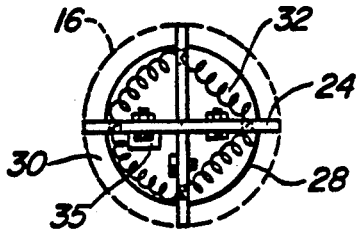
FIG. 4 is an end view of the heater element assembly for the air supply unit shown in FIG. 2.

FIGS. 3 and 4 are detailed respective side and end views of the heater element assembly 20. The heater element assembly 20 includes a heater mounting support 24, which may comprise formed sheets of a highly temperature resistant insulating material, such as mica or ceramic, which form a rigid support for the heater element assembly 20 in the discharge conduit 16 (shown in broken line in FIG. 3) having a low resistance to the flow of air in the discharge conduit 16 so as to minimize turbulence therein. The cross-sectional configuration for the mounting support 24, which is clearly evident in FIG. 4, is only one convenient arrangement, and the mounting support 24 may have fewer or more support sides extending to the inner wall of the discharge conduit 16, according to design choice. In any case, the sides of the mounting support 24 include substantially linear central recesses 26 along the length of the mounting support 24.

The recesses 26 provide linear mounting surfaces for supporting an insulating sheath 28 which circumscribes the mounting support 24 about the central recesses 26. The central recesses 26 thus allow the insulating sheath 28 to be firmly mounted to the mounting support 24 while providing a substantial circumferential gap 30 between the insulating sheath 28 and the wall of the discharge conduit 16. The circumferential gap 30 is sufficiently open and unobstructed to maintain substantially laminar flow therein. Although the insulating sheath is shown as a generally cylindrical tube, it can have a variety of configurations, such as a generally square or rectangular tubular configuration, according to design choice and the configuration of the discharge conduit 16 itself. For instance, if the discharge conduit has a generally square tubular configuration, it is desirable for the insulating sheath to have a corresponding configuration to maintain the circumferential gap 30 substantially constant about the periphery of the discharge conduit 16. The insulating sheath 28 may be of any highly temperature resistant insulating material, such as mica or ceramic.

The heater element assembly 20 also includes a heater element 32 which is centrally mounted on the mounting support 24 within the insulating sheath 28. Although shown as two separate coiled-wire type resistance elements 32A and 32B spirally wound around the mounting support 24 in a bifil configuration, the heater element 32 may be only one, or more than two, such elements. Likewise, the heater element 32 may be straight resistance wire either wrapped around the mounting support 24 within the insulating sheath 28 or extending along the length of the mounting support 24 within the insulating sheath 28. So too, the heater element 32 may comprise at least one or two rods of heat generating resistive material mounted along the length of the mounting support 24 within the insulating sheath 28. When winding the heater element 32 around the mounting support 24, it may be convenient to include alignment notches 34 at defined points along the edges of the central recesses 26 to provide a more secure mounting for the heater element 32 and to provide more clearance for the insulating sheath 28.

When air flows through the heater element assembly 20 in the discharge conduit 16, air flows through both the interior of the insulating sheath 28 and the circumferential gap 30 surrounding the insulating sheath 28. The air which flows within the insulating sheath 28 is heated by the heater element 32 to provide a hot air discharge from the discharge outlet 18. However, the air that is forced through the circumferential gap 30 is relatively cool, because the insulating sheath 28 isolates the heater element 32 from the air flow in the circumferential gap 30. Thus, the air flow through the circumferential gap 30 provides a circumferential blanket of relatively cool air discharge from the discharge outlet 18 which surrounds the discharge of hot air from within the insulating sheath 28. Due to the velocity and viscosity of the forced air stream exiting the discharge outlet 18, the air stream exiting from the discharge outlet 18 remains largely laminar and maintains its hot core region surrounded by a cool blanket layer through the coupling hose 6 sufficiently far downstream from the heater element assembly 20 so that the high air temperature generated within the heater element assembly 20 decays enough to have no detrimental effect on ordinary plastic materials. Thus, the air supply unit 4, the coupling hose 6 and the dryer head 8 may all be constructed of economical plastics without component failure, due to heat degradation.

The heater element assembly 20 may also contain protective devices, such as a thermal fuse 33 and a thermal circuit breaker 35, to prevent the heater element 32 from generating excessive temperatures within the air supply unit 4. The thermal fuse 33, the thermal circuit breaker 35 and the heater element 32 are generally connected in a series electric circuit configuration so that the thermal circuit breaker 35 interrupts the circuit for the heater element 32 during intervals of moderately excessive temperature rise conditions, such as may be caused by extended operation periods, partial blockage of intake air to the air supply unit 4 or momentary stalling of the motor for the air blower and baffle assembly 12.

The thermal fuse 33 opens the circuit for the heater element 32 when the dryer assembly 2 is subjected to more severe temperature rises of a more serious nature, such as complete stoppage of air flow through the heater assembly 20 due to motor failure. Therefore, the thermal fuse 33 opens, and stays open, when its rated temperature is exceeded, unlike the thermal circuit breaker 35, which will close the circuit once again after it cools down. Unfortunately, the close proximity of the insulating sheath 28 to the heater element 32, coupled with the vertical orientation of the heater element assembly 20 mounted in the air supply unit 4, allows extremely hot air to rise into, and surround, the thermal fuse 33 whenever the dryer assembly 2 is turned off. The thermal fuse 33 can be exposed to hot air rising into the heater element assembly 20 and mingling around the thermal fuse 33 which has a temperature sufficient to exceed the temperature rating of the fuse, causing disablement of the dryer assembly 2 until the thermal fuse 33 is replaced.

As part of the present invention, the length of the insulating sheath 28 may be reduced to leave most of, or all of, the thermal fuse 33 uncovered by the insulating sheath 28. In this way, hot air is able to dissipate outward away from the thermal fuse 33 whenever the air supply unit 4 is switched off. However, since the insulating sheath 28 is downstream from the thermal fuse 33 in this case, the air stream exiting of the discharge outlet 18 is still substantially laminar, with its hot core region surrounded by a relatively cool blanket of air.

Figure 5:
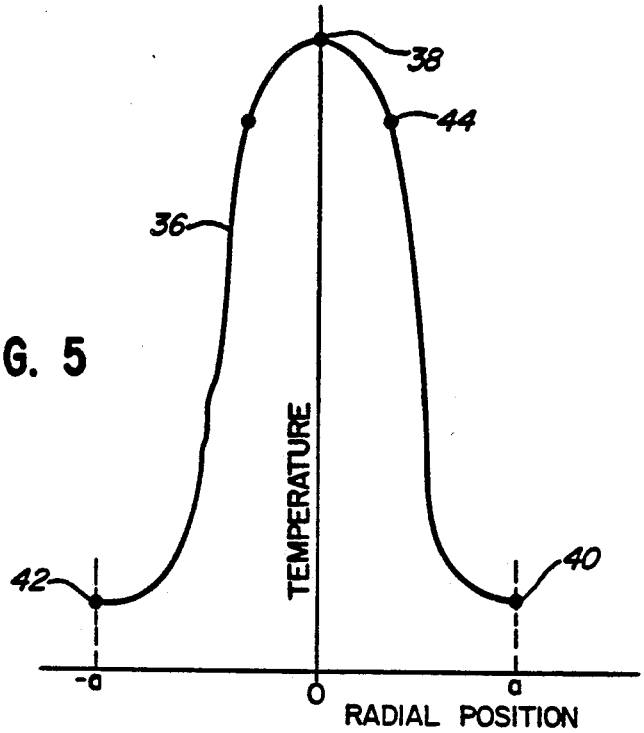
FIG. 5 is a graphical representation of a typical temperature gradient profile for the discharge outlet of the air supply unit shown in FIG. 2.

With the heater element assembly 20, installed in the air supply unit 4, a typical temperature gradient profile for the discharge outlet 18 is graphically represented in FIG. 5. Line 36 represents outlet temperature as a function of radial position in the discharge outlet 18. The central axis of the discharge outlet 18 is represented by point 38, which corresponds to the peak temperature in the discharged air stream from the discharge outlet 18. Points 40 and 42 represent the temperatures along a radial displacement coincident with the peripheral wall of the discharge outlet 18 in opposite radial directions. Points 44 and 46 represent the temperature of the discharged air stream from the discharge outlet 18 along a radial displacement coincident with the wall of the insulating sheath 28. It thus is apparent that the laminated air flows of the hot central core region surrounded by the blanket of cool air prevail even downstream from the insulating sheath 28.

Figure 6:
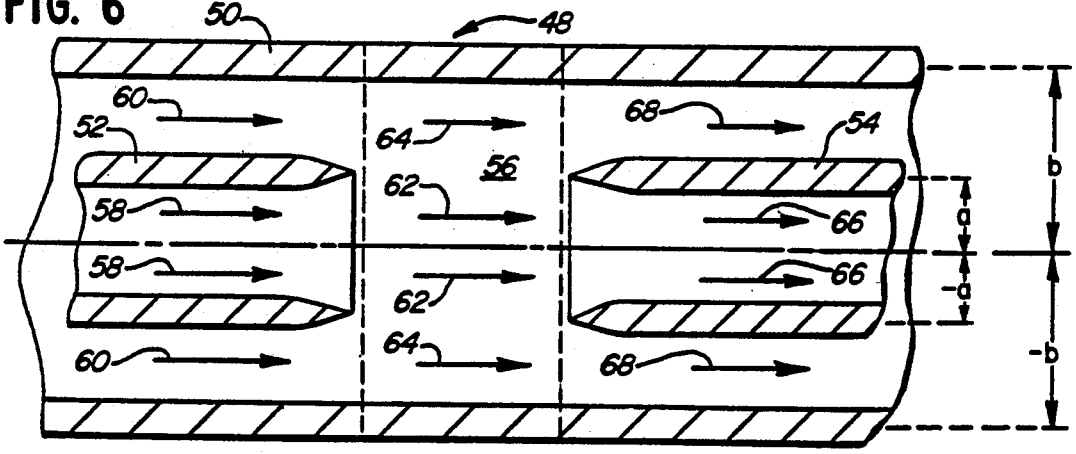
FIG. 6 is a transmission conduit incorporating the present invention.

Accordingly, the concept of the present invention described above in connection with the preferred embodiment of the invention may be extended to the more generalized application of transmitting gases or fluids at elevated or reduced temperatures with a maximum of efficiency. As shown in FIG. 6, a transmission conduit 48 includes a peripheral wall 50, a first insulating sheath 52 and a second insulating sheath 54, both the first insulating sheath 52 and the second insulating sheath 54 axially aligned with each other within the transmission conduit 48. The transmission conduit 48 also includes a coupling region 56 which has no insulating sheath within it. This coupling region 56 may be a coupler, a coupling hose, or other conduit where a central insulating sheath may be impractical to incorporate.

Fluid flow through the first insulating sheath 50, represented by arrows 58, has sufficient velocity to establish substantially laminar flow in the direction indicated by the arrows 58. Fluid flow through the transmission conduit 48 surrounding the first insulating sheath 52 also has sufficient velocity to establish laminar flow in the direction represented by arrows 60. Because the flows both within and surrounding the first insulating sheath 52 are substantially laminar, their discharges through the coupling region remain relatively laminar as well. Therefore, the flow in the central region of the coupling region 56, represented by arrows 62, corresponds to the flow within the first insulating sheath 52, and the flow in the peripheral region of the coupling region 56, represented by arrows 64, corresponds to the flow surrounding the first insulating sheath 52. If the fluid flows within and surrounding the first insulating sheath 52 are of different temperatures, this temperature differential will be substantially maintained even within the coupling region 56.

Since the laminar flow is substantially retained in the coupling region 56, at least if the coupling region 56 is not of extended length, the flows can be once again individually transmitted within and surrounding the second insulating sheath 54, so that the flow within the second insulating sheath 54, represented by arrows 66, substantially corresponds to the flow that passes through the first insulating sheath 52, with little interaction and temperature change. Likewise, the flow outside the second insulating sheath 54, represented by arrows 68, substantially corresponds to the flow passing outside the first insulating sheath 52. Therefore, efficient transfer of fluid is maintained with little temperature change between inlet and outlet flows. Of course, the fluid flow within the insulating sheaths may be either below or above ambient temperature level. So too, the fluid flow outside of the insulating sheaths may be above or below the ambient temperature level.

Figure 7:
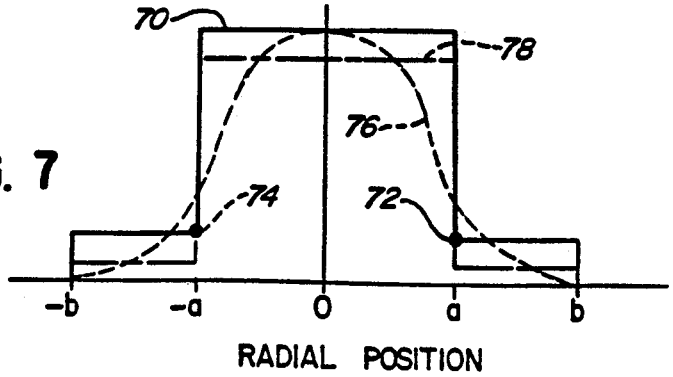
FIG. 7 is a graphical representation of typical temperature gradient profiles of the transmission conduit shown in FIG. 6 at different positions along the conduit.

FIG. 7 is a graphical representation of typical temperature gradients or a function of radial position which typify the transmission conduit 48 described above. Line 70 represents the temperature gradient within the section of the transmission conduit 48 including the first insulating sheath 52. The temperature shifts at points 72 and 74 correspond to the wall of the first insulating sheath 52 in opposite radial directions.

Line 76 corresponds to the temperature gradient within the coupling region 56. It is evident that the gradient within the coupling region 56 is very similar to that section of the transmission conduit 48 including the first insulating sheath 52. Thus, substantial laminar flow with little turbulence occurs in the coupling region 56.

Line 78 represents the temperature gradient in the section of the transmission conduit 48 including the second insulating sheath 54. It is evident that little temperature change has occurred from the temperature gradient in the section of the transmission conduit 48 including the first insulating sheath 52.

It will be understood that various changes in the details, arrangements and configurations of the parts and assemblies described and illustrated above in order to explain the nature of the present invention may be made by those skilled in the art within the principle and scope of the invention as expressed in the appended claims.

What is claimed is:

1. A transmission system for a high pressure fluid flow through a flow transmission conduit, comprising:

a generally tubular fluid flow transmission conduit, including a conduit inlet and a conduit outlet for transporting a high pressure fluidic flow from said conduit inlet to said conduit outlet;

a first tubular insulating sheath mounted within said transmission conduit downstream from said conduit inlet to divide said high pressure fluidic flow into axially aligned laminar central core and annular peripheral inlet flow streams which are thermally insulated with respect to each other; and a second tubular insulating sheath mounted within said transmission conduit upstream from said conduit outlet to divide high pressure flow through said transmission conduit into axially aligned laminar central core and annular peripheral outlet flow streams which are thermally insulated from each other, and correspond to said central core and annular peripheral inlet flow streams respectively;

wherein a gap between said first and second insulating sheaths in said transmission conduit has a length sufficiently small to maintain laminar flow in said transmission conduit between them.

2. The transmission system recited in claim 1, wherein said first and second insulating sheaths are axially aligned within said transmission conduit and have substantially identical cross sectional configurations and areas.

* * * * *

UNITED STATES PATENT AND TRADEMARK OFFICE

CERTIFICATE OF CORRECTION

PATENT NO. : 5,243,682
DATED : September 7, 1993
INVENTOR(S) : Allen F. Eberts

It is certified that error appears in the above-indentified patent and that said Letters Patent is hereby corrected as shown below:

In column 1, line 61, before "separated" delete "and" and substitute --air--.

In column 2, line 34, delete "2" and substitute --1--.

In column 4, line 14, delete "bifil" and substitute --bifilar--.

Column 6,

In claim 1, line 1, delete "fluid" and substitute --fluidic--.

Signed and Sealed this

First Day of November, 1994

Bruce Lehman

*Attest:*

BRUCE LEHMAN

*Attesting Officer*

*Commissioner of Patents and Trademarks*